US011315475B2

(12) United States Patent
Xuan et al.

(10) Patent No.: US 11,315,475 B2
(45) Date of Patent: Apr. 26, 2022

(54) PIXEL DRIVING CIRCUIT, DRIVING METHOD THEREOF, AND DISPLAY DEVICE

(71) Applicant: BOE Technology Group Co., Ltd., Beijing (CN)

(72) Inventors: Minghua Xuan, Beijing (CN); Ning Cong, Beijing (CN); Dongni Liu, Beijing (CN); Can Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/417,243

(22) PCT Filed: Oct. 30, 2020

(86) PCT No.: PCT/CN2020/125119

§ 371 (c)(1),
(2) Date: Jun. 22, 2021

(87) PCT Pub. No.: WO2021/083308

PCT Pub. Date: May 6, 2021

(65) Prior Publication Data

US 2022/0084456 A1 Mar. 17, 2022

(30) Foreign Application Priority Data

Nov. 1, 2019 (CN) ..... 201911061710.4

(51) Int. Cl.
*G09G 3/20* (2006.01)
*G09G 3/3233* (2016.01)
*G09G 3/3291* (2016.01)

(52) U.S. Cl.
CPC ..... *G09G 3/2092* (2013.01); *G09G 3/3233* (2013.01); *G09G 3/3291* (2013.01); *G09G 2310/08* (2013.01)

(58) Field of Classification Search
CPC ..... G09G 3/32; G09G 3/3677; G09G 3/3266; G09G 3/3233; G09G 3/3648;
(Continued)

(56) References Cited

U.S. PATENT DOCUMENTS

2003/0063078 A1 4/2003 Hanari et al.
2020/0211452 A1* 7/2020 Lee ..... G09G 3/3233
(Continued)

FOREIGN PATENT DOCUMENTS

CN 106847190 A 6/2017
CN 107103878 A 8/2017
(Continued)

OTHER PUBLICATIONS

Office Action dated Sep. 29, 2021 issued in corresponding Chinese Application No. 201911061710.4.

*Primary Examiner* — Dong Hui Liang
(74) *Attorney, Agent, or Firm* — Nath, Goldberg & Meyer; Joshua B. Goldberg

(57) ABSTRACT

A pixel driving circuit includes: current control sub-circuit outputting driving current in response to light emission control signal of the light emission control signal terminal; time control sub-circuit transmitting time modulation signal of the time modulation signal terminal to the third control terminal in response to time control signal of the time control signal terminal, and controlling time during which the driving current flows through the light emitting element; initial time control sub-circuit transmitting initial control signal of the initial control signal terminal to the output terminal of the initial time control sub-circuit in response to initial time control signal of the initial time control signal terminal. Time control sub-circuit controls the time during which the driving current flows through the light emitting element in response to time modulation signal transmitted to
(Continued)

the third control terminal and initial control signal transmitted to the third control terminal.

19 Claims, 4 Drawing Sheets

(58) Field of Classification Search
CPC ..... G09G 3/3225; G09G 3/2014; G09G 2300/0426; G09G 2300/0809; G09G 2300/0842; G09G 2300/0861; G09G 2300/0439; G09G 2310/061; G09G 2330/021; G09G 2320/0233; G09G 2320/0646
See application file for complete search history.

(56) References Cited

U.S. PATENT DOCUMENTS

| | | | | |
|---|---|---|---|---|
| 2020/0211477 | A1* | 7/2020 | Lai ..... | G09G 3/3266 |
| 2020/0265777 | A1* | 8/2020 | Shigeta ..... | G09G 3/2014 |

FOREIGN PATENT DOCUMENTS

| | | | |
|---|---|---|---|
| CN | 108172170 | A | 6/2018 |
| CN | 108538241 | A | 9/2018 |
| CN | 108847181 | A | 11/2018 |
| CN | 109697960 | A | 4/2019 |
| CN | 109920371 | A | 6/2019 |
| CN | 110310594 | A | 10/2019 |

* cited by examiner

PIXEL DRIVING CIRCUIT, DRIVING METHOD THEREOF, AND DISPLAY DEVICE

CROSS REFERENCE TO RELATED APPLICATION

This is a National Phase Application filed under 35 U.S.C. 371 as a national stage of PCT/CN2020/125119, filed on Oct. 30, 2020, an application claims priority to Chinese Patent Application No. 201911061710.4 filed with the China National Intellectual Property Administration on Nov. 1, 2019, the disclosed contents of each of which are incorporated herein by reference in their entirety.

TECHNICAL FIELD

The present disclosure relates to the field of display technology, in particular to a pixel driving circuit and a driving method thereof, and a display device.

BACKGROUND

Micro-scale inorganic light-emitting diodes are a new generation of display technology, and have higher brightness, better luminous efficiency, and lower power consumption than existing OLEDs. The outstanding characteristics of micro-scale inorganic light-emitting diodes make them applicable to TVs, iPhones, and iPads. The luminous efficiency of a micro-scale inorganic light-emitting diode at low current density decreases as the current density decreases. If only the current density is used to modulate the gray scale, a low gray scale corresponds to a low current density, and the luminous efficiency of the micro-scale inorganic light-emitting diode decreases, thereby affecting the display quality. In addition, the chromaticity coordinates of the micro-scale inorganic light-emitting diode change as the current density changes, that is to say, the display of the micro-scale inorganic light-emitting diodes will have a color shift when the gray scale changes. Therefore, the pixel driving circuit for the micro-scale inorganic light-emitting diode often modulates the gray scale through both current and operating time.

SUMMARY

In a first aspect, embodiments of the present disclosure provide a pixel driving circuit, including: a current control sub-circuit having an input terminal coupled to a data voltage terminal, a control terminal coupled to a light emission control signal terminal, and an output terminal, and configured to generate a driving current for a light emitting element according to a data voltage of the data voltage terminal, and output the driving current from the output terminal in response to a light emission control signal of the light emission control signal terminal; a time control sub-circuit having a first control terminal coupled to a time control signal terminal, a second control terminal coupled to a time modulation signal terminal, an input terminal coupled to the output terminal of the current control sub-circuit, an output terminal coupled to the light emitting element, and a third control terminal, and configured to receive the driving current from the current control sub-circuit at the input terminal of the time control sub-circuit, and transmit a time modulation signal of the time modulation signal terminal to the third control terminal in response to a time control signal of the time control signal terminal, and control time during which the driving current flows through the light emitting element; and an initial time control sub-circuit having an input terminal coupled to an initial control signal terminal, a control terminal coupled to an initial time control signal terminal and an output terminal coupled to the third control terminal of the time control sub-circuit, and configured to transmit an initial control signal of the initial control signal terminal to the output terminal of the initial time control sub-circuit in response to an initial time control signal of the initial time control signal terminal. The time control sub-circuit controls the time during which the driving current flows through the light emitting element in response to the time modulation signal transmitted from the time control sub-circuit to the third control terminal and the initial control signal transmitted from the initial time control sub-circuit to the third control terminal.

In some embodiments, the initial time control sub-circuit includes a third transistor having a first electrode coupled to the initial control signal terminal, a second electrode coupled to the third control terminal of the time control sub-circuit, and control electrode coupled to the initial time control signal terminal.

In some embodiments, the time control sub-circuit includes a first transistor and a second transistor, and the first transistor has a first electrode coupled to the time modulation signal terminal, a second electrode coupled to the third control terminal of the time control sub-circuit, and a control electrode coupled to the time control signal terminal; the second transistor has a first electrode coupled to the output terminal of the current control sub-circuit, a second electrode coupled to the light emitting element, and a control electrode coupled to the third control terminal of the time control sub-circuit.

In some embodiments, the time control sub-circuit further includes: a first storage capacitor having a first terminal coupled to the third control terminal of the time control sub-circuit and configured to store the time modulation signal and the initial control signal transmitted to the third control terminal.

In some embodiments, the current control sub-circuit includes: a switching transistor configured to transmit the data voltage in response to a scan signal; a driving transistor configured to generate the driving current according to the data voltage transmitted from the switching transistor; a threshold compensation transistor configured to compensate a threshold voltage of the driving transistor in response to the scan signal; a second storage capacitor configured to store the data voltage transmitted to the driving transistor; a reset transistor configured to provide a path for discharging charges stored in the second storage capacitor in response to a reset signal; a first light emission control transistor configured to provide a power supply voltage to the driving transistor in response to the light emission control signal; and a second light emission control transistor configured to output the driving current from the output terminal of the current control sub-circuit in response to the light emission control signal.

In some embodiments, the switching transistor has a first electrode coupled to the data voltage terminal, a second electrode coupled to a first electrode of the first light emission control transistor and a first electrode of the driving transistor, and a control electrode coupled to a scan signal terminal configured to provide the scan signal; the driving transistor has a second electrode coupled to a second electrode of the threshold compensation transistor and a first electrode of the second light emission control transistor, and a control electrode coupled to a second terminal of the second storage capacitor, a first electrode of the reset transistor and a first electrode of the threshold compensation transistor; the first electrode of the threshold compensation transistor is further coupled to the first electrode of the reset transistor, and a control electrode of the threshold compensation transistor is coupled to the scan signal terminal; a first terminal of the second storage capacitor is coupled to a power supply voltage terminal configured to provide a power supply voltage; the reset transistor has a second electrode coupled to an initialization signal terminal, and a control electrode coupled to a reset signal terminal configured to provide the reset signal; the first light emission control transistor has a second electrode coupled to the power supply voltage terminal, and a control electrode coupled to the light emission control signal terminal; and the second light emission control transistor has a second electrode coupled to the input terminal of the time control sub-circuit, and a control electrode coupled to the light emission control signal terminal.

In some embodiments, the light emitting element includes: a micro-scale inorganic light-emitting diode.

In a second aspect, embodiments of the present disclosure provide a driving method of a pixel driving circuit. The pixel driving circuit is the above pixel driving circuit. The method includes: before a level of the light emission control signal of the light emission control signal terminal changes from an inactive level to an active level, applying an initial control signal with an active level to the initial control signal terminal, applying an initial time control signal with an active level to the initial time control signal terminal, and applying a time control signal with an inactive level to the time control signal terminal; and applying an initial time control signal with an inactive level to the initial time control signal terminal at a time point not earlier than a time point at which the level of the light emission control signal at the light emission control signal terminal changes from the inactive level to the active level, and applying a time control signal including a pulse having an inactive level to the time control signal terminal after the level of the light emission control signal at the light emission control signal terminal changes from the inactive level to the active level.

In some embodiments, the pixel driving circuit is provided in a display device, and a frame period for the display device to display one frame of pictures includes a preset stage, a first light-emitting stage, and a second light-emitting stage in sequence. In the preset stage, a light emission control signal with an inactive level is applied to the light emission control signal terminal, an initial time control signal with an active level is applied to the initial time control signal terminal, and a time control signal with an inactive level is applied to the time control signal terminal; in the first light-emitting stage, a light emission control signal with an active level is applied to the light emission control signal terminal, an initial time control signal with an inactive level is applied to the initial time control signal terminal, and a time control signal with an inactive level is applied to the time control signal terminal; and in the second light-emitting stage, a light emission control signal with an active level is applied to the light emission control signal terminal, an initial time control signal with an inactive level is applied to the initial time control signal terminal, and a time control signal having a plurality of active time periods is applied to the time control signal terminal, the active time period being a time period during which the time control signal has an active level, and the plurality of active time periods being spaced apart in time.

In some embodiments, in the second light-emitting stage, a time modulation signal with an active level is applied to the time modulation signal terminal during at least one active time period of the time control signal to increase the time during which the driving current flows through the light emitting element.

In a third aspect, embodiments of the present disclosure provide a display device, including the above pixel driving circuits and light emitting elements, and the light emitting elements are current driven devices.

In some embodiments, the pixel driving circuits are arranged in an array, and pixel driving circuits in a same row share a same initial time control sub-circuit.

In some embodiments, the pixel driving circuits are arranged in an array; the display device further includes a plurality of scan lines, a plurality of data lines, a plurality of time control signal lines, a plurality of time modulation signal lines, a plurality of initial control signal lines, and a plurality of initial modulation signal lines. Current control sub-circuits of pixel driving circuits located in a same row are coupled to a same scan line; current control sub-circuits of pixel driving circuits located in a same column are coupled to a same data line; control electrodes of first transistors of the pixel driving circuit located in the same row are coupled to a same time control signal line; first electrodes of first transistors of the pixel driving circuits located in the same column are coupled to a same time modulation signal line; initial time control sub-circuits of the pixel driving circuits located in the same row are coupled to a same initial control signal line; and initial time control sub-circuits of the pixel driving circuits located in the same row or in the same column are coupled to a same initial modulation signal line.

DETAILED DESCRIPTION

Figure 1:
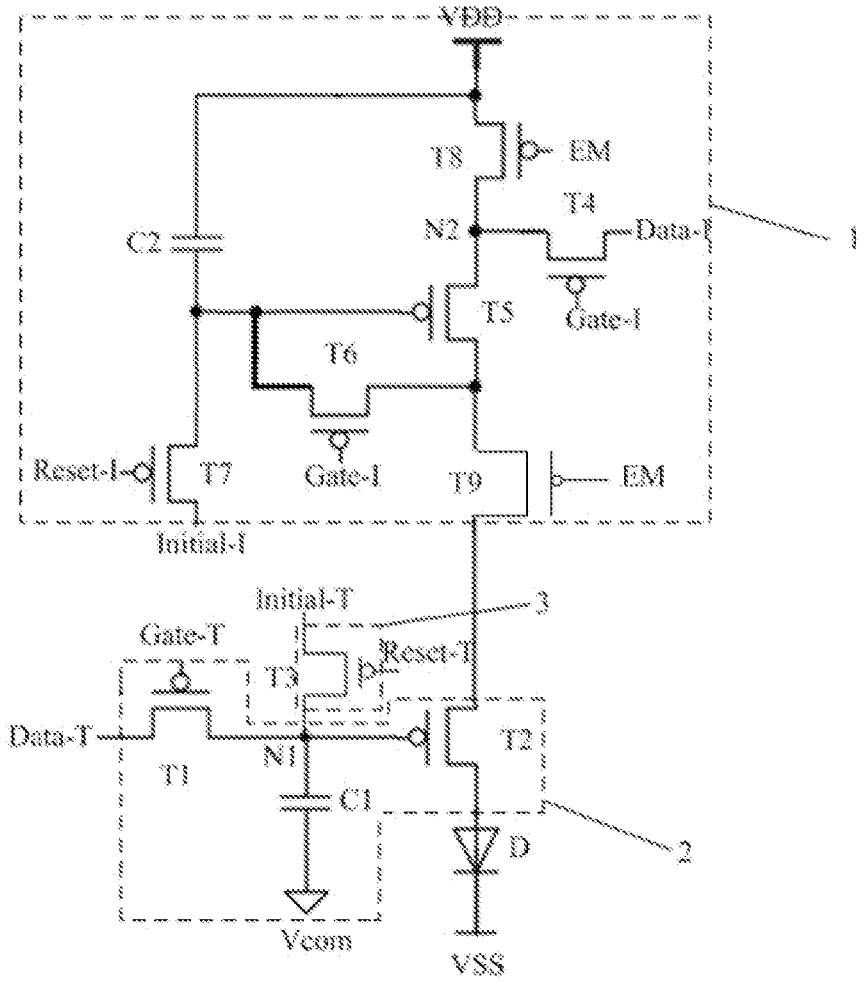
FIG. 1 is a circuit diagram of a pixel driving circuit according to an embodiment of the present disclosure.

In order to make those skilled in the art better understand technical solutions of the present disclosure, the present disclosure will be further described in detail below with reference to the accompanying drawings and specific implementations.

Unless otherwise defined, technical terms or scientific terms used in the present disclosure shall have the usual meanings understood by those of ordinary skill in the art to which this disclosure belongs. The "first", "second" and similar terms used in the present disclosure do not indicate any order, quantity or importance, but rather are used to distinguish different components. Similarly, the terms such as "a", "one", "the" and the like do not denote a limitation of quantity, but rather denote the presence of at least one. The term "include" or "comprise" or the like means that the element or item appearing in front of the term encompasses the element or item listed after the term and its equivalents, and does not exclude other elements or items. The terms "connected", "coupled" and the like are not restricted to physical or mechanical connections, but may include electrical connections, whether direct or indirect. The terms "upper", "lower", "left", "right", and the like are used merely to indicate relative positional relationships, which may also change accordingly when an absolute position of an object being described changes.

A transistor used in embodiments of the present disclosure may be a thin film transistor, a field effect transistor, or other device with the same characteristics. Since the source electrode and the drain electrode of the used transistor are symmetrical, there is no difference between the source electrode and the drain electrode. In the embodiments of the present disclosure, in order to distinguish the source electrode from the drain electrode of the transistor, one of the electrodes is called a first electrode, the other is called a second electrode, and the gate electrode is called a control electrode. In addition, transistors maybe classified into N-type transistors and P-type transistors according to their characteristics. In the following embodiments, description is given by taking P-type transistors as an example. In the case of using a P-type transistor, the first electrode is the source electrode of the P-type transistor, the second electrode is the drain electrode of the P-type transistor, and the source electrode and the drain electrode are electrically connected when a low level is input to the gate electrode. In the case of using a N-type transistor, the first electrode is the source electrode of the N-type transistor, the second electrode is the drain electrode of the N-type transistor, and the source electrode and the drain electrode are electrically connected when a high level is input to the gate electrode. It is conceivable that an implementation of N-type transistors can be easily conceived by those skilled in the art without creative efforts and therefore is within the protection scope of the embodiments of the present disclosure.

It should be noted that, in the embodiments of the present disclosure, all transistors are P-type transistors as an example, an active level refers to a level that causes the P-type transistor to be turned on, that is, a low level, and an inactive level refers to a high level. An initial control signal in the embodiments of the present disclosure is at a fixed active level, i.e., is a fixed low-level signal.

In the embodiments of the present disclosure, a light emitting element D of the micro-scale inorganic light-emitting diode is a current driven device, further, it may be a current driven light-emitting diode, and further, it may be a Micro Light Emitting Diode (Micro LED). In this case, operating time described in the present disclosure can be understood as light-emitting time of the light emitting element, i.e., time during which driving current flows through the light emitting element; a first electrode and a second electrode of the light emitting element D are an anode and a cathode of the light-emitting diode, respectively.

Figure 4:
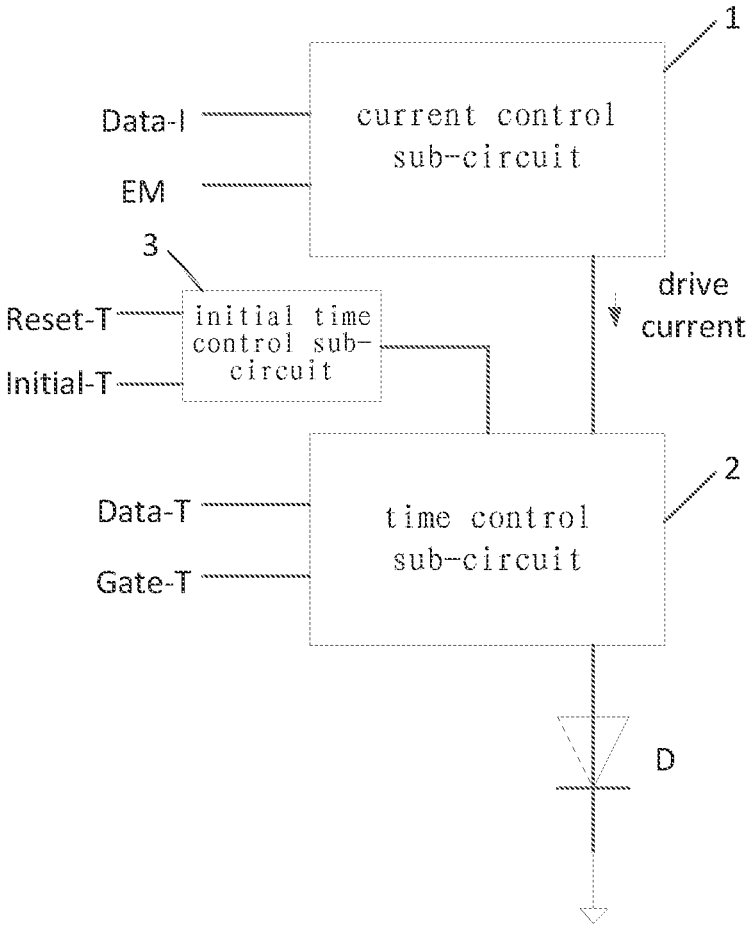
FIG. 4 is a block diagram of a pixel driving circuit according to an embodiment of the present disclosure.

In a first aspect, as shown in FIG. 4, an embodiment of the present disclosure provides a pixel driving circuit, including: a current control sub-circuit 1, a time control sub-circuit 2, and an initial time control sub-circuit 3. The current control sub-circuit 1 has an input terminal coupled to a data voltage terminal Data-I, a control terminal coupled to a light emission control signal terminal EM, and an output terminal, and is configured to generate a driving current for a light emitting element D according to a data voltage of the data voltage terminal Data-I, and output the driving current from the output terminal in response to a light emission control signal of the light emission control signal terminal EM. The time control sub-circuit 2 has a first control terminal coupled to a time control signal terminal Gate-T, a second control terminal coupled to a time modulation signal terminal Data-T, an input terminal coupled to the output terminal of the current control sub-circuit, an output terminal coupled to the light emitting element D and a third control terminal, and is configured to receive, at the input terminal of the time control sub-circuit 2, the driving current from the current control sub-circuit, transmit a time modulation signal of the time modulation signal terminal Data-T to the third control terminal in response to a time control signal of the time control signal terminal Gate-T, and control time during which the driving current flows through the light emitting element D. The initial time control sub-circuit 3 has an input terminal coupled to an initial control signal terminal Initial-T, a control terminal coupled to an initial time control signal terminal Reset-T, and an output terminal coupled to the third control terminal of the time control sub-circuit 2, and is configured to transmit an initial control signal of the initial control signal terminal Initial-T to the output terminal of the initial time control sub-circuit 3 in response to an initial time control signal of the initial time control signal terminal Reset-T. The time control sub-circuit 2 controls the time during which the driving current flowing through the light emitting element D in response to the time modulation signal transmitted from the time control sub-circuit 2 to the third control terminal and the initial control signal transmitted from the initial time control sub-circuit 3 to the third control terminal.

FIG. 1 shows a circuit diagram of a pixel driving circuit according to an embodiment of the present disclosure. As shown in FIG. 1, the time control sub-circuit 2 includes: a first transistor T1 and a second transistor T2. The first transistor T1 transmits a time modulation signal in response to a time control signal; the initial time control sub-circuit 3 transmits an initial control signal in response to an initial time control signal; the second transistor T2 controls light-emitting time of the light emitting element D in response to the time modulation signal and the initial control signal.

In some embodiments, the time control sub-circuit 2 may further include a first storage capacitor C1 configured to store the time modulation signal and the initial control signal transmitted to the second transistor T2. For example, the first terminal of the first storage capacitor C1 is coupled to the third control terminal of the initial time control sub-circuit (see node N1 in FIG. 1).

Specifically, as shown in FIG. 1, a second electrode of the first transistor T1, a control electrode of the second transistor T2, and the third control terminal of the initial time control sub-circuit 3 are all coupled to the node N1. During display of one frame of picture, in a first light-emitting stage, the initial time control sub-circuit 3 may be controlled to operate through the initial time control signal, and the initial control signal is written into the N1 node; at the same time, a driving current generated by the current control sub-circuit 1 is controlled, and, at this point, since the potential of the node N1 is the potential of the initial control signal, i.e., a low level, the second transistor T2 is turned on, and therefore, the driving current can drive the light emitting element D to emit light through the second transistor T2; in a second light-emitting stage, the time control signal is a low-level signal, the first transistor T1 is turned on, the node N1 is pulled high if the time modulation signal is a high-level signal, the second transistor T2 is turned off, the light emitting element D stops emitting light, in this case, the light-emitting time of the light emitting element D is very short, and the light-emitting time is a time period from a time point at which the initial time control signal becomes a high level to a time point at which the time modulation signal is a high-level signal and is transmitted to the node N1, however, if the time modulation signal is a low-level signal and is transmitted to the node N1, the node N1 remains at a low level at this time, the second transistor T2 remains on, the light emitting element D continues emitting light, and in this case, the light-emitting time of the light emitting element D can last until the time control signal turns into a high-level signal.

It can be understood that in the embodiments of the present disclosure, during one active time period of the light emission control signal terminal EM, by providing a time modulation signal having different amplitudes through the time modulation signal terminal in a time period during which the time control signal terminal is at an active level, the light-emitting time having at least two different time durations can be achieved, that is, a plurality of scans within display time of one frame can be achieved. This pixel driving circuit can be applied to a high-resolution display panel.

In some embodiments, the initial time control sub-circuit 3 may include a third transistor T3, and the third transistor T3 transmits the initial control signal in response to the initial time control signal. The third transistor T3 has a first electrode coupled to the initial control signal terminal Initial-T, a second electrode coupled to the second electrode of the first transistor T1, the first terminal of the first storage capacitor C1, and the control electrode of the second transistor T2 (i.e., coupled to the node N1), and a control electrode coupled to the initial time control signal terminal Reset-T.

Specifically, when a low-level signal is written into the initial time control signal terminal Reset-T, the third transistor T3 is turned on, and a low-level signal loaded to the initial control signal terminal Initial-T is written to the node N1. When the current control sub-circuit 1 generates a driving current, because the node N1 is at a low level at this time, the second transistor T2 is turned on, and the driving current flows into the light emitting element D through the second transistor T2, so that the light emitting element D emits light.

In some embodiments, a first electrode of the first transistor T1 is coupled to the time modulation signal terminal Data-T, the second electrode of the first transistor T1 is coupled to the initial time control sub-circuit 3, the first terminal of the first storage capacitor C1, and the control electrode of the second transistor T2 (i.e., coupled to the node N1), and a control electrode of the first transistor T1 is coupled to the time control signal terminal Gate-T. A first electrode of the second transistor T2 is coupled to the current control sub-circuit 1, a second electrode of the second transistor T2 is coupled to the light emitting element D, and the control electrode of the second transistor T2 is coupled to the node N1. A second terminal of the first storage capacitor C1 is coupled to a common voltage terminal Vcom.

Specifically, in the second light-emitting stage, a low-level signal is written into the time control signal terminal Gate-T, the first transistor T1 is turned on, at this time, if a high-level signal is written into the time modulation signal terminal Data-T, the node N1 is pulled high, the second transistor T2 is turned off, and the light emitting element D stops emitting light; if a low-level signal is written into the time modulation signal terminal Data-T, the node N1 remains at a low level, the second transistor T2 remains on, and the light emitting element D continues emitting light.

In some embodiments, the current control sub-circuit 1 may include a switching transistor T4, a driving transistor T5, a threshold compensation transistor T6, a second storage capacitor C2, a reset transistor T7, a first light emission control transistor T8, and a second light emission control transistor T9. The switching transistor T4 transmits a data voltage in response to a scan signal. The driving transistor T5 is configured to generate a driving current according to the data voltage transmitted from the switching transistor T4. The threshold compensation transistor T6 compensates a threshold voltage of the driving transistor T5 in response to the scan signal. The second storage capacitor C2 is configured to store the data voltage transmitted to the second transistor T2. The reset transistor T7 provides a path for discharging charges stored in the second storage capacitor C2 in response to a reset signal, for example, the data voltage stored in the storage capacitor C2 may be pulled down to an initialization voltage provided by an initialization signal terminal Initial-I. The first light emission control transistor T8 provides a power supply voltage to the driving transistor T5 in response to a light emission control signal. The second light emission control transistor T9 outputs, in response to the light emission control signal, a driving current for the light emitting element D from the output terminal (e.g., the second electrode of the second light emission control transistor T9) of the current control sub-circuit 1.

Specifically, a first electrode of the switching transistor T4 is coupled to a data voltage terminal Data-I, a second electrode of the switching transistor T4 is coupled to a first electrode of the first light emission control transistor T8 and a first electrode of the driving transistor T5 (i.e., coupled to a node N2), and a control electrode of the switching transistor T4 is coupled to a scanning signal terminal Gate-I. A second electrode of the driving transistor T5 is coupled to a second electrode of the threshold compensation transistor T6 and a first electrode of the second light emission control transistor T9, and a control electrode of the driving transistor T5 is coupled to a second terminal of the second storage capacitor C2 and a first electrode of the reset transistor T7. A first electrode of the threshold compensation transistor T6 is also coupled to the first electrode of the reset transistor T7, and a control electrode of the threshold compensation transistor T6 is coupled to the scan signal terminal Gate-I. A first terminal of the second storage capacitor C2 is coupled to a second electrode of the first light emission control transistor T8 and a first power supply voltage terminal VDD. A second electrode of the reset transistor T7 is coupled to an initialization signal terminal Initial-I, and a control electrode of the reset transistor T7 is coupled to a reset signal terminal Reset-I. A control electrode of the first light emission control transistor T8 is coupled to the light emission control signal terminal EM. A second electrode of the second light emission control transistor T9 is coupled to the first electrode of the second transistor T2, and a control electrode of the second light emission control transistor T9 is coupled to the light emission control signal terminal EM.

In some embodiments, the reset signal terminal Reset-I coupled to the control electrode of the reset transistor T7 and the initial time control signal terminal Reset-T coupled to the control electrode of the third transistor T3 in the above-mentioned pixel driving circuit may be a same terminal, that is, a reset signal is used as an initial time control signal. In this way, the third transistor T3 can be turned on by the reset signal during a reset stage of the pixel driving circuit, and at the same time, an initial control signal is written into the node N1 and stored in the first storage capacitor C1.

It should be noted that there is provided above only the specific structure of one current control sub-circuit 1. It should be understood that the current control sub-circuit 1 in the embodiments of the present disclosure is not limited to the above structure, and may be any current control sub-circuit 1 capable of generating a driving current for the light emitting element. The specific operating process of the above current control sub-circuit will be described in conjunction with the following driving method.

In a second aspect, embodiments of the present disclosure provide a driving method of a pixel driving circuit, and the pixel driving circuit may be any of the above pixel driving circuits. The method includes: before a level of the light emission control signal at the light emission control signal terminal changes from an inactive level to an active level, applying an initial control signal having an active level to the initial control signal terminal, applying an initial time control signal having an active level to the initial time control signal terminal, and applying a time control signal having an inactive level to the time control signal terminal; applying an initial time control signal having an inactive level to the initial time control signal terminal at a time point not earlier than a time point at which the level of the light emission control signal at the light emission control signal terminal changes from the inactive level to the active level, and applying a time control signal including a pulse having an inactive level to the time control signal terminal after the level of the light emission control signal at the light emission control signal terminal changes from the inactive level to the active level.

In some embodiments, the pixel driving circuit is provided in a display device, and a frame period for the display device to display one frame of picture includes a preset stage, a first light-emitting stage, and a second light-emitting stage in sequence. In the preset stage, a light emission control signal with an inactive level is applied to the light emission control signal terminal, an initial time control signal with an active level is applied to the initial time control signal terminal, and a time control signal with an inactive level is applied to the time control signal terminal. In the first light-emitting stage, a light emission control signal with an active level is applied to the light emission control signal terminal, an initial time control signal with an inactive level is applied to the initial time control signal terminal, and a time control signal with an inactive level is applied to the time control signal terminal. In the second light-emitting stage, a light emission control signal with an active level is applied to the light emission control signal terminal, an initial time control signal with an inactive level is applied to the initial time control signal terminal, and a time control signal having a plurality of active time periods is applied to the time control signal terminal, the active time period being a time period during which the time control signal has an active level, and the plurality of active time periods being spaced apart in time.

In some embodiments, in the second light-emitting stage, a time modulation signal with an active level is applied to the time modulation signal terminal during at least one active time period of the time control signal to increase the time during which the driving current flows through the light emitting element.

For example, in the preset stage (e.g., S3 in FIG. 2), the initial time control signal input to the initial time control sub-circuit 3 is at a low level, the initial control signal is written to the control electrode of the second transistor T2, and optionally, the first storage capacitor C1 is charged, and the second transistor T2 is turned on. In the following first light-emitting stage (e.g., S4 in FIG. 2), the light emission control signal at the light emission control signal terminal becomes a low level, and the current control sub-circuit 1 provides a driving current to drive the light emitting element D through the second transistor T2. Then, in the second light-emitting stage (e.g., S5 in FIG. 2), the light emission control signal at the light emission control signal terminal remains low, the time control signal is a low-level signal, and the first transistor T1 is turned on. At this time, if the time modulation signal is a high-level signal, the control electrode of the second transistor T2 is pulled high, the second transistor T2 is turned off, and the light emitting element D stops emitting light; if the time modulation signal is a low-level signal, the control electrode of the second transistor T2 remains low, and the light emitting element D continuously emits light.

It can be seen that in the embodiments of the present disclosure, during one active time period of the light emission control signal terminal EM, by providing a time modulation signal having different amplitudes through the time modulation signal terminal in a time period during which the time control signal terminal is at an active level, the light-emitting time having at least two different time durations can be achieved, that is, a plurality of scans within display time of one frame can be achieved. Because the voltage at the third control terminal (e.g., node N1 in FIG. 1) of the time control sub-circuit is prepared in advance through the initial time control sub-circuit 3 before the light emission control signal turns into an active level, the pixel driving circuit can be advantageously applied to a high-resolution display panel.

In order to make the operating principle of the pixel driving circuit of the embodiments of the present disclosure clearer, description is given by taking a case where the current control sub-circuit 1 in the pixel driving circuit includes: a switching transistor T4, a driving transistor T5, a threshold compensation transistor T6, a second storage capacitor C2, a reset transistor T7, a first light emission control transistor T8 and a second light emission control transistor T9; the initial time control sub-circuit 3 includes a third transistor T3 as an example.

Specifically, as shown in FIG. 1, a first electrode of the switching transistor T4 is coupled to a data voltage terminal Data-I, a second electrode of the switching transistor T4 is coupled to a first electrode of the first light emission control transistor T8 and a first electrode of the driving transistor T5 (i.e., coupled to node N2), and a control electrode of the switching transistor T4 is coupled to the scan signal terminal Gate-I. A second electrode of the driving transistor T5 is coupled to a second electrode of the threshold compensation transistor T6 and a first electrode of the second light emission control transistor T9, and a control electrode of the driving transistor T5 is coupled to a second terminal of the second storage capacitor C2 and a first electrode of the reset transistor T7. A first electrode of the threshold compensation transistor T6 is also coupled to the first electrode of the reset transistor T7, and a control electrode of the threshold compensation transistor T6 is coupled to the scan signal terminal Gate-I. A first terminal of the second storage capacitor C2 is coupled to a second electrode of the first light emission control transistor T8 and a first power supply voltage terminal VDD. A second electrode of the reset transistor T7 is coupled to the initialization signal terminal Initial-I, and a control electrode of the reset transistor T7 is coupled to the reset signal terminal Reset-I. A control electrode of the first light emission control transistor T8 is coupled to the light emission control signal terminal EM. A second electrode of the second light emission control transistor T9 is coupled to a first electrode of a second transistor T2, and a control electrode of the second light emission control transistor T9 is coupled to the light emission control signal terminal EM. A first electrode of a first transistor T1 is coupled to the time modulation signal terminal Data-T, a second electrode of the first transistor T1 is coupled to a second electrode of the third transistor T3 of the initial time control sub-circuit 3, a first terminal of a first storage capacitor C1, and a control terminal of the second transistor T2 (i.e., coupled to node N1), and a control electrode of the first transistor T1 is coupled to the time control signal terminal Gate-T. The first electrode of the transistor T2 is coupled to the second electrode of the threshold compensation transistor T6 and the second electrode of the driving transistor T5, a second electrode of the second transistor T2 is coupled to a first electrode of the light emitting element D, and a control electrode of the second transistor T2 is coupled to the node N1. A second terminal of the first storage capacitor C1 is coupled to the common voltage terminal Vcom. A second electrode of the light emitting element D is coupled to a second power supply voltage terminal VSS. A first electrode of the third transistor T3 is coupled to the initial control signal terminal Initial-T, a second electrode is coupled to the second electrode of the first transistor T1, the first terminal of the first storage capacitor C1, and the control electrode of the second transistor T2 (i.e., coupled to the node N1), and a control electrode of the third transistor T3 is coupled to the initial time control signal terminal Reset-T.

It should be noted that the data signal provided by the data voltage terminal Data-I may be a fixed high-level signal that allows the to-be-driven light emitting element D to have a relatively high luminous efficiency. In this case, the pixel driving circuit controls the gray scale mainly through the time control sub-circuit 2. Alternatively, the potential of the first data signal may vary within a certain voltage range, the first data signal within the voltage range can ensure that the to-be-driven light emitting element D has a relatively high luminous efficiency, and in this case, the pixel driving circuit controls the gray scale through the current control sub-circuit 1 together with the time control sub-circuit 2.

Figure 2:
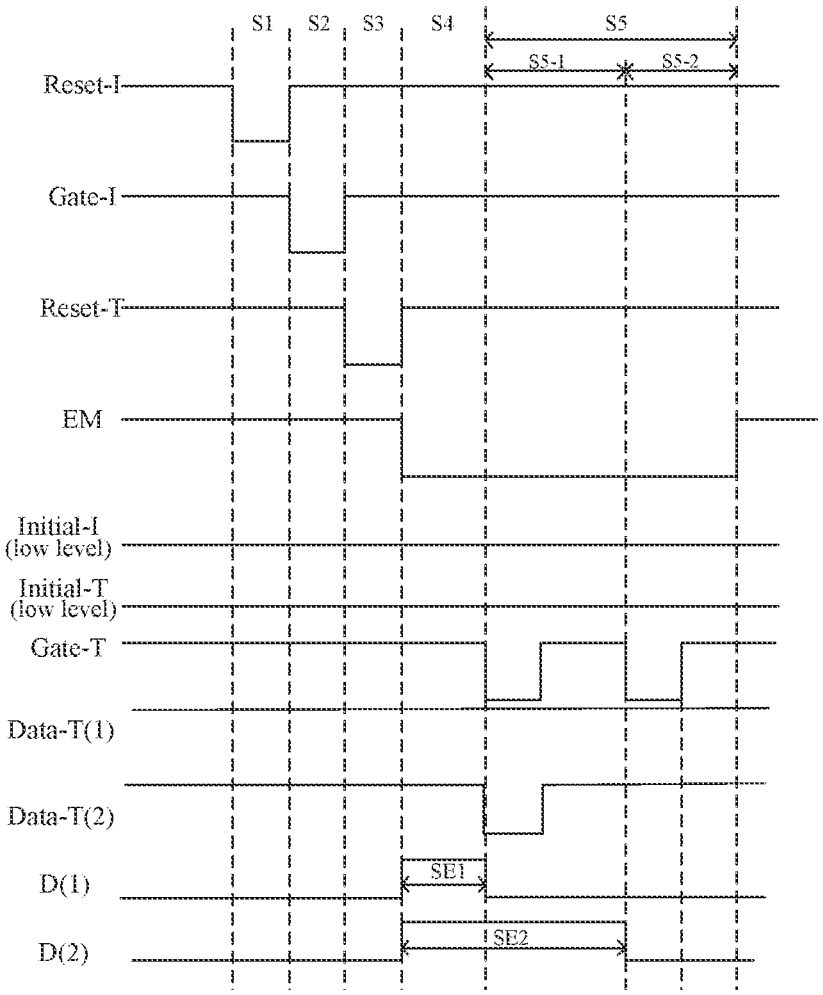
FIG. 2 is an operating timing diagram of a pixel driving circuit according to an embodiment of the present disclosure.

In conjunction with FIG. 2, the driving method of the pixel driving circuit of the embodiments of the present disclosure may specifically include the following stages S1 to S5.

In a reset stage S1, a low-level signal is input to the reset signal terminal Reset-I, the reset transistor T7 is turned on, and an initialization signal is input to the initialization signal terminal Initial-I to discharge the second terminal of the second storage capacitor C2 to initialize its potential.

In a data writing and threshold compensation stage S2, a low-level signal is input to the scan signal terminal Gate-I, at this time the switching transistor T4, the driving transistor T5 and the threshold compensation transistor T6 are all turned on, that is, the gate electrode and the second electrode of the driving transistor T5 are coupled to make the driving transistor T5 in a self-saturation state, and since the potential of the node N2 is Vdata, Vdata-Vth is written to the control electrode of the driving transistor T5 and the first terminal of the second storage capacitor C2, where Vth is the threshold voltage of the driving transistor T5.

In a preset stage S3, a low-level signal is input to the initial time control signal terminal Reset-T, the third transistor T3 is turned on, and the low-level signal applied to the initial control signal terminal Initial-T is transmitted to the node N1 and stored in the first storage capacitor C1.

In a first light-emitting stage S4, a low level is written to the light emission control signal terminal EM, a high-level signal is input to the initial time control signal terminal Reset-T, and the first light emission control transistor T8 and the second light emission control transistor T9 are turned on; the first storage capacitor C1 maintains the low level of the node N1, and the second transistor T2 is turned on to drive the light emitting element D to emit light.

It should be noted here that the reset signal terminal Reset-I coupled to the control electrode of the reset transistor T7 of the pixel driving circuit and the initial time control signal terminal Reset-T coupled to the control electrode of the third transistor T3 may be the same terminal, that is, the reset signal may be used as the initial time control signal. Therefore, the third transistor T3 can be turned on by the reset signal in the reset stage of the pixel driving circuit, and at the same time, the initial time modulation signal is written into the node N1 and stored in the first storage capacitor C1. In this way, as long as a low level is written into the light emission control signal terminal EM in the first light-emitting stage, the first light emission control transistor T8 and the second light emission control transistor T9 are turned on; the first storage capacitor C1 maintains the low level of the node N1, the second transistor T2 is turned on, and the driving current generated by the driving transistor T5 can drive the light emitting element D to emit light.

It should be noted that in the first light-emitting stage, at the moment when the light emission control signal terminal is changed from an inactive level to an active level, the low-level potential applied to the initial control signal terminal Initial-T stored in the node N1 will control the second transistor T2 to be turned on, and the light emitting element D emits light.

In a second light-emitting stage S5, a low level is continuously written to the light emission control signal terminal EM, and a low-level signal is input to the time control signal terminal Gate-T at least once.

As shown in FIG. 2, taking a case where a signal with an active level is written to the time control signal terminal Gate-T twice as an example, if a high-level signal is written to the first time modulation signal terminal Data-T(1) in each of the two active time periods of the time control signal terminal Gate-T, the node N1 is set high from the beginning of the first active time period of the time control signal terminal Gate-T, so that the second transistor T2 is turned off and the light emitting element D stops emitting light. In this case, the light-emitting time of the light emitting element D(1) is the time period SE1 shown in FIG. 2 (i.e., the light emitting element only emits light in the first light-emitting stage S4). If a low-level signal is written to the first time modulation signal terminal Data-T(2) in the first one of the two active time periods of the time control signal terminal Gate-T and a high-level signal is written to the first time modulation signal terminal Data-T(2) in the second one of the two active time periods, the node N1 is set high from the beginning of the second active time period of the time control signal terminal Gate-T, and the second transistor T2 remains on from a time point at which a low level starts to be written to the light emission control signal terminal EM to the beginning of the second active time period of the time control signal terminal Gate-T. In this case, the light-emitting time of the light emitting element D(2) is the time period SE2 shown in FIG. 2 (i.e., the light emitting element emits light in the first light-emitting stage S4 and the sub-stage S5-1 in the second light-emitting stage S5, and does not emit light in the sub-stage S5-2 in the second light-emitting stage S5).

Under the condition that the time control signal terminal Gate-T has two active time periods in the time period during which a low level is continuously written to the emission control signal terminal EM, when signals with different levels are written to the first time modulation signal terminal Data-T in the active time periods, two light-emitting durations among four different light-emitting durations that can be achieved are described above as an example.

It can be understood that, during the display of one frame of picture, for each pixel, relationship between the number of times n that the voltage signal of the first time modulation signal terminal Data-T is written to the node N1 (i.e., the number of times n of the active time periods of Gate-T) from the beginning of writing an active level to the light emission control signal terminal EM and the number K of the light-emitting durations that the pixel can achieve is: $K=2^n$, and the second light-emitting stage S5 may include n sub-stages S5-1 to S5-*n*.

In a third aspect, embodiments of the present disclosure also provide a display device, which includes any one of the above pixel driving circuits. Therefore, the display device of the embodiments may have a relatively high resolution.

In some embodiments, the pixel driving circuits in the display device may correspond to pixel units arranged in an array and be arranged in an array. In this case, pixel units in a same row share a same initial time control sub-circuit 3, which can further reduce wiring space of a display panel and facilitates achievement of high-resolution display of the display device.

Figure 3:
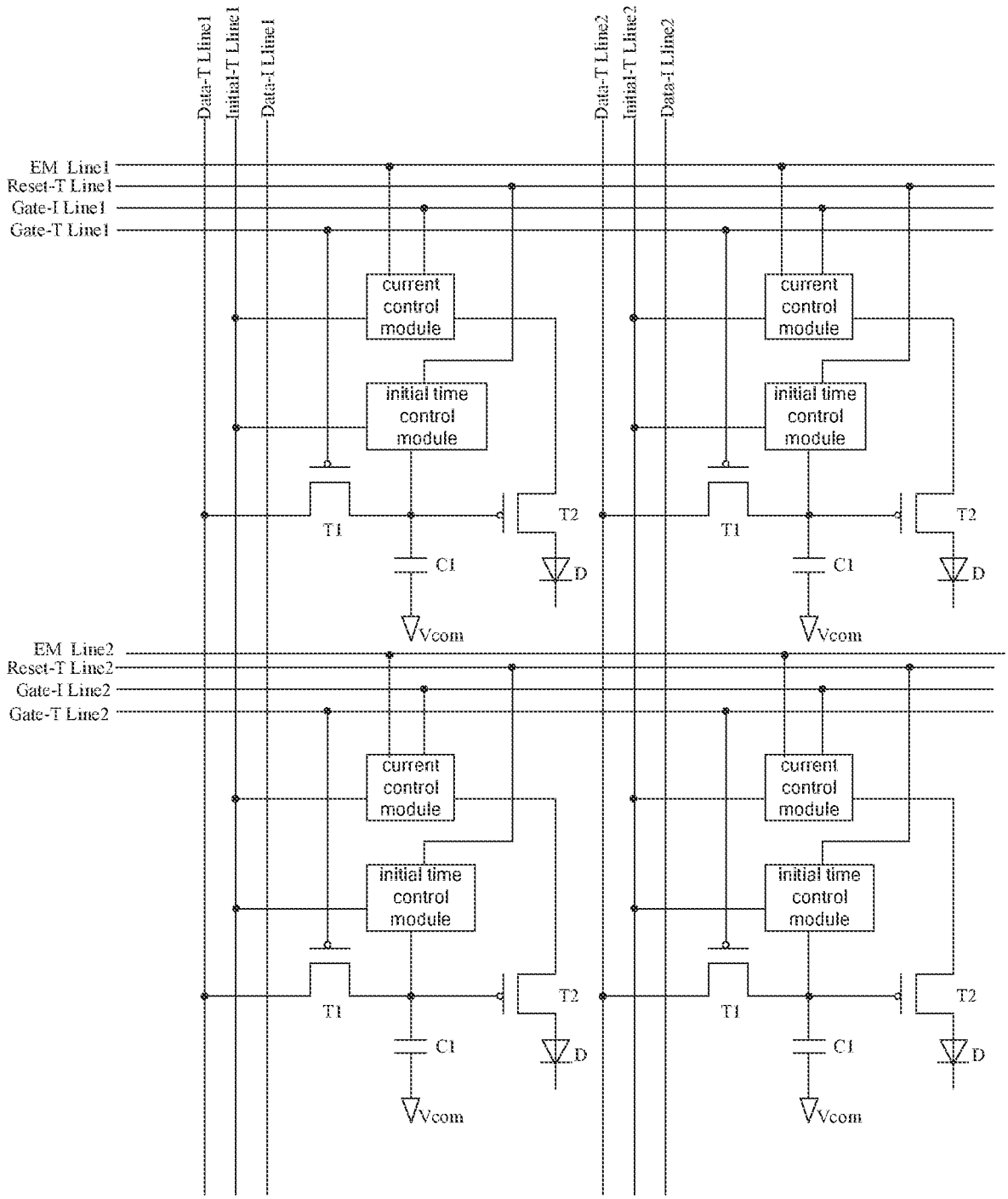
FIG. 3 is a schematic diagram showing arrangement of a pixel driving circuit of a display device according to an embodiment of the present disclosure.

In some embodiments, as shown in FIG. 3, the pixel driving circuit is arranged in an array; the display device also includes a plurality of scan lines, a plurality of data lines, a plurality of time control signal lines, a plurality of time modulation signal lines; a plurality of initial control signal lines, and a plurality of initial modulation signal lines. The current control sub-circuits 1 of the pixel driving circuits located in a same row are coupled to a same scan line. The current control sub-circuits 1 of the pixel driving circuits located in a same column are coupled to a same data line. The control electrodes of the first transistors T1 of the pixel driving circuits located in a same row are coupled to a same time control signal line. The first electrodes of the first transistors T1 of the pixel driving circuits located in a same column are coupled to a same time modulation signal line. The initial time control sub-circuits 3 of the pixel driving circuits located in a same row are coupled to a same initial control signal line. The initial time control sub-circuits 3 of the pixel driving circuits located in a same row or in a same column are coupled to a same initial modulation signal line.

It should be noted that, FIG. 3 only schematically shows four pixel driving circuits in two rows and two columns, but this does not represent the actual number of the pixel driving circuits in the display device. In FIG. 3, Gate-T Line1 and Gate-T Line2 represent the time control signal lines coupled to the pixel driving circuits in the first row and the second row respectively; Gate-I Line1 and Gate-I Line2 represent scan lines coupled to the pixel driving circuits in the first row and the second row respectively; Reset-T Line1 and Reset-T Line2 represent the initial time control signal lines coupled to the pixel driving circuits in the first row and the second row respectively; EM Line1 and EM Line2 represent light emission control lines coupled to the pixel driving circuits in the first row and the first row respectively; Data-T Line1 and Data-T Line2 represent the time modulation signal lines coupled to the pixel driving circuits in the first column and the second column respectively; Data-I Line1 and Data-I Line2 represent the data lines coupled to the pixel driving circuits in the first column and the second column respectively; Initial-T Line1 and Initial-T Line2 represent the initial control signal lines coupled to the pixel driving circuits in the first column and the second column respectively. Moreover, FIG. 3 only illustrates a case where the initial time control sub-circuits 3 located in a same column are coupled to a same initial control signal line as an example, and in fact, the initial time control sub-circuits 3 located in a same row may be coupled to a same initial control signal line. In this way, the entire panel is lit row by row, and each row of pixels can perform display sequentially according to the timing diagram shown in FIG. 2.

As an example, the current control sub-circuit of each pixel driving circuit includes: a switching transistor T4, a driving transistor T5, a threshold compensation transistor T6, a second storage capacitor C2, a reset transistor T7, a first light emission control transistor T8, and a second light emission control transistor T9; the initial time control sub-circuit 3 includes a third transistor T3, the connection relationship is as described above, and will not be repeated here.

The control electrodes of the switching transistors T4 and the sixth transistors T6 of the pixel driving circuits in a same row are coupled to a same scan line. The first electrodes of the switching transistors T4 of the pixel driving circuits in a same column are coupled to a same data line. The control electrodes of the reset transistors T7 of the pixel driving circuits in a same row are coupled to a same reset signal line. The first electrodes of the reset transistors T7 of the pixel driving circuits in a same row are coupled to a same initialization signal line. The control electrodes of the eight transistors T8 and the ninth transistor T9 s of the pixel driving circuits in a same row are coupled to a same light emission control line. The control electrodes of the first transistors of the pixel driving circuits in a same row are coupled to a same time control signal line. The first electrodes of the first transistors of the pixel driving circuits in a same column are coupled to a same time modulation signal line. The control electrodes of the third transistors of the pixel driving circuits in a same row are coupled to a same initial time control signal line. The first electrodes of the third transistors of the pixel driving circuits in a same row or in a same column are coupled to a same initial control signal line.

With the above wiring manner, the wiring space of the panel can be saved, thereby realizing a high-resolution panel design. The display device may be a liquid crystal display device, an electroluminescent display device, or any product or component with a display function such as a liquid crystal panel, an OLED panel, a MicroLED panel, a MiniLED panel, a mobile phone, a tablet computer, a television, a monitor, a notebook computer, a digital photo frame, a navigator, etc.

It can be understood that the above implementations are merely exemplary implementations used to illustrate the principle of the present disclosure, but the present disclosure is not limited thereto. For those of ordinary skill in the art, various modifications and improvements can be made without departing from the spirit and essence of the present disclosure, and these modifications and improvements are also deemed to be within the protection scope of the present disclosure.

What is claimed is:

1. A pixel driving circuit, comprising:

a current control sub-circuit having an input terminal coupled to a data voltage terminal, a control terminal coupled to a light emission control signal terminal, and an output terminal and configured to generate a driving current for a light emitting element according to a data voltage of the data voltage terminal, and output the driving current from the output terminal in response to a light emission control signal of the light emission control signal terminal;

a time control sub-circuit having a first control terminal coupled to a time control signal terminal, a second control terminal coupled to a time modulation signal terminal, an input terminal coupled to the output terminal of the current control sub-circuit, an output terminal coupled to the light emitting element, and a third control terminal, and configured to receive the driving current from the current control sub-circuit at the input terminal of the time control sub-circuit, and transmit a time modulation signal of the time modulation signal terminal to the third control terminal in response to a time control signal of the time control signal terminal, and control time during which the driving current flows through the light emitting element; and an initial time control sub-circuit having an input terminal coupled to an initial control signal terminal, a control terminal coupled to an initial time control signal terminal and an output terminal coupled to the third control terminal of the time control sub-circuit, and configured to transmit an initial control signal of the initial control signal terminal to the output terminal of the initial time control sub-circuit in response to an initial time control signal of the initial time control signal terminal, wherein the time control sub-circuit controls the time during which the driving current flows through the light emitting element in response to the time modulation signal transmitted from the time control sub-circuit to the third control terminal and the initial control signal transmitted from the initial time control sub-circuit to the third control terminal.

2. The pixel driving circuit of claim 1, wherein the time control sub-circuit comprises a first transistor and a second transistor, and the first transistor has a first electrode coupled to the time modulation signal terminal, a second electrode coupled to the third control terminal of the time control sub-circuit, and a control electrode coupled to the time control signal terminal, and the second transistor has a first electrode coupled to the output terminal of the current control sub-circuit, a second electrode coupled to the light emitting element, and a control electrode coupled to the third control terminal of the time control sub-circuit.

3. The pixel driving circuit of claim 2, wherein the time control sub-circuit further comprises: a first storage capacitor having a first terminal coupled to the third control terminal of the initial time control sub-circuit and configured to store the time modulation signal and the initial control signal transmitted to the third control terminal.

4. A display device, comprising pixel driving circuits, each of which is the pixel driving circuit of claim 3, and light emitting elements, wherein the light emitting elements are current driven devices.

5. A display device, comprising pixel driving circuits, each of which is the pixel driving circuit of claim 2, and light emitting elements, wherein the light emitting elements are current driven devices.

6. The pixel driving circuit of claim 1, wherein the current control sub-circuit comprises:

a switching transistor configured to transmit the data voltage in response to a scan signal;

a driving transistor configured to generate the driving current according to the data voltage transmitted from the switching transistor;

a threshold compensation transistor configured to compensate a threshold voltage of the driving transistor in response to the scan signal;

a second storage capacitor configured to store the data voltage transmitted to the driving transistor;

a reset transistor configured to provide a path for discharging charges stored in the second storage capacitor in response to a reset signal;

a first light emission control transistor configured to provide a power supply voltage to the driving transistor in response to the light emission control signal; and a second light emission control transistor configured to output the driving current from the output terminal of the current control sub-circuit in response to the light emission control signal.

7. The pixel driving circuit of claim 6, wherein the switching transistor has a first electrode coupled to the data voltage terminal, a second electrode coupled to a first electrode of the first light emission control transistor and a first electrode of the driving transistor, and a control electrode coupled to a scan signal terminal configured to provide the scan signal;

the driving transistor has a second electrode coupled to a second electrode of the threshold compensation transistor and a first electrode of the second light emission control transistor, and a control electrode coupled to a second terminal of the second storage capacitor, a first electrode of the reset transistor and a first electrode of the threshold compensation transistor;

a control electrode of the threshold compensation transistor is coupled to the scan signal terminal;

a first terminal of the second storage capacitor is coupled to a power supply voltage terminal configured to provide a power supply voltage;

the reset transistor has a second electrode coupled to an initialization signal terminal, and a control electrode coupled to a reset signal terminal configured to provide the reset signal;

the first light emission control transistor has a second electrode coupled to the power supply voltage terminal, and a control electrode coupled to the light emission control signal terminal; and the second light emission control transistor has a second electrode coupled to the input terminal of the time control sub-circuit, and a control electrode coupled to the light emission control signal terminal.

8. A display device, comprising pixel driving circuits, each of which is the pixel driving circuit of claim 7, and light emitting elements, wherein the light emitting elements are current driven devices.

9. A display device, comprising pixel driving circuits, each of which is the pixel driving circuit of claim 6, and light emitting elements, wherein the light emitting elements are current driven devices.

10. A driving method of a pixel driving circuit, the pixel driving circuit being the pixel driving circuit of claim 1, and the method comprising:

before a level of the light emission control signal of the light emission control signal terminal changes from an inactive level to an active level, applying an initial control signal with an active level to the initial control signal terminal, applying an initial time control signal with an active level to the initial time control signal terminal, and applying a time control signal with an inactive level to the time control signal terminal; and applying an initial time control signal with an inactive level to the initial time control signal terminal at a time point not earlier than a time point at which the level of the light emission control signal at the light emission control signal terminal changes from the inactive level to the active level, and applying a time control signal comprising a pulse having an inactive level to the time control signal terminal after the level of the light emission control signal at the light emission control signal terminal changes from the inactive level to the active level.

11. The method of claim 10, wherein the pixel driving circuit is provided in a display device, and a frame period for the display device to display one frame of pictures comprises a preset stage, a first light-emitting stage, and a second light-emitting stage in sequence, in the preset stage, a light emission control signal with an inactive level is applied to the light emission control signal terminal, an initial time control signal with an active level is applied to the initial time control signal terminal, and a time control signal with an inactive level is applied to the time control signal terminal, in the first light-emitting stage, a light emission control signal with an active level is applied to the light emission control signal terminal, an initial time control signal with an inactive level is applied to the initial time control signal terminal, and a time control signal with an inactive level is applied to the time control signal terminal, and in the second light-emitting stage, a light emission control signal with an active level is applied to the light emission control signal terminal, an initial time control signal with an inactive level is applied to the initial time control signal terminal, and a time control signal having a plurality of active time periods is applied to the time control signal terminal, the active time period being a time period during which the time control signal has an active level, and the plurality of active time periods being spaced apart in time.

12. The method of claim 11, wherein in the second light-emitting stage, a time modulation signal with an active level is applied to the time modulation signal terminal during at least one active time period of the time control signal to increase the time during which the driving current flows through the light emitting element.

13. A display device, comprising pixel driving circuits, each of which is the pixel driving circuit of claim 1, and light emitting elements, wherein the light emitting elements are current driven devices.

14. The display device of claim 13, wherein the pixel driving circuits are arranged in an array, and pixel driving circuits in a same row share a same initial time control sub-circuit.

15. The display device of claim 13, wherein the pixel driving circuits are arranged in an array; the display device further comprises a plurality of scan lines, a plurality of data lines, a plurality of time control signal lines, a plurality of time modulation signal lines, a plurality of initial control signal lines, and a plurality of initial modulation signal lines, wherein current control sub-circuits of pixel driving circuits located in a same row are coupled to a same scan line; current control sub-circuits of pixel driving circuits located in a same column are coupled to a same data line;

control electrodes of first transistors of the pixel driving circuit located in the same row are coupled to a same time control signal line; first electrodes of first transistors of the pixel driving circuits located in the same column are coupled to a same time modulation signal line; and initial time control sub-circuits of the pixel driving circuits located in the same row are coupled to a same initial control signal line; and initial time control sub-circuits of the pixel driving circuits located in the same row or in the same column are coupled to a same initial modulation signal line.

16. The pixel driving circuit of claim 1, wherein the initial time control sub-circuit comprises a third transistor having a first electrode coupled to the initial control signal terminal, a second electrode coupled to the third control terminal of the time control sub-circuit, and a control electrode coupled to the initial time control signal terminal.

17. A display device, comprising pixel driving circuits, each of which is the pixel driving circuit of claim 16, and light emitting elements, wherein the light emitting elements are current driven devices.

18. The pixel driving circuit of claim 1, wherein the light emitting element comprises: a micro-scale inorganic light-emitting diode.

19. A display device, comprising pixel driving circuits, each of which is the pixel driving circuit of claim 18, and light emitting elements, wherein the light emitting elements are current driven devices.

* * * * *